US005078376A

United States Patent [19]

Yamada et al.

[11] Patent Number: 5,078,376

[45] Date of Patent: Jan. 7, 1992

[54] COPYING MACHINE WITH BINDING FUNCTION

[75] Inventors: Masami Yamada, Osaka; Yoshiki Yoshioka, Kyoto, both of Japan

[73] Assignee: Mita Industrial Co., Ltd., Osaka, Japan

[21] Appl. No.: 553,081

[22] Filed: Jul. 17, 1990

[30] Foreign Application Priority Data

Jul. 18, 1989 [JP] Japan ..... 1-185613

[51] Int. Cl.[5] ..... B42B 1/02

[52] U.S. Cl. ..... 270/53; 270/37

[58] Field of Search ..... 270/1.1, 37, 53, 58; 355/324

[56] References Cited

U.S. PATENT DOCUMENTS 4,878,656 11/1989 Honjo ..... 270/53

FOREIGN PATENT DOCUMENTS 235260 9/1988 Japan ..... 270/37

75364 3/1989 Japan ..... 270/1.1

236164 9/1989 Japan ..... 270/53

*Primary Examiner*—Edward K. Look

*Assistant Examiner*—Therese M. Newholm

*Attorney, Agent, or Firm*—Cushman, Darby & Cushman

[57] ABSTRACT

A copying machine having a binding function capable of automatically binding discharged copied sheets using a predetermined holding device includes a binding function selection unit and a maximum bindable sheet count displaying unit. Since the maximum bindable number of sheets of an original can be displayed according to a copying mode prior to copying, the binding function of the copying machine can be utilized more effectively.

9 Claims, 3 Drawing Sheets

COPYING MACHINE WITH BINDING FUNCTION

BACKGROUND OF THE INVENTION

1. Field of the Invention

The present invention relates to a copying machine having a binding function capable of automatically binding discharged copied sheets using a predetermined holding member such as a staple or a clip.

2. Description of the Related Art

Copying machines having a binding function are proposed for instance as described in Japanese Patent Unexamined Publication No. 48777/1989.

Such a binding function in the copying machine contributes to reducing manpower and reducing the time required for copying work in offices and the like. The time savings is especially noticeable when utilized in combination with a discharged sheet sorting function and the like.

When binding the copied sheets by a binding function, there is a limit in the number of copies that can be bound. This maximum bindable number of copies is only indicated in an instruction manual and the like in a conventional copying machine with a binding function.

On the other hand, the number of copied sheets to be discharged from the copying machine depends on the combination of the number of sheets of an original and the selected copying mode. For example, in a double-sided copying mode in which each of plural single-sided original sheets is sequentially copied on both sides of a copying sheet, the number of copied sheets to be discharged is half that of the originals. In contrast, in a separate copying mode in which a sheet of a double-sided original is copied in two separate copying sheets, the number of copied sheets to be discharged is twice that of the original.

Since the number of copied sheets with respect to that of the sheets of an original vary depending on the copying mode in this way, there has existed a shortcoming that it is difficult to correctly know the maximum bindable number of sheets of an original prior to copying.

SUMMARY OF THE INVENTION

The present invention has been made to overcome the above shortcoming and has therefore as an object the provision of a copying machine capable of displaying the maximum bindable number of sheets of an original prior to copying.

The above object of the present invention is achieved by the copying machine having a binding function capable of automatically binding discharged copied sheets using a predetermined holding member, wherein means for selecting a binding function; and means for displaying, prior to copying, a maximum bindable number of sheets based on an output of the selection means are included.

As a result of the above construction, the maximum bindable number of sheets of an original can be displayed according to the copying mode prior to copying, thereby allowing the binding function to be utilized effectively.

BRIEF DESCRIPTION OF THE DRAWINGS

These and other aspects of the invention will now be described in detail with reference to the accompanying drawings, wherein.

DETAILED DESCRIPTION OF THE PREFERRED EMBODIMENT

An embodiment of the present invention will now be described in detail with reference to the accompanying drawings.

Figure 2:
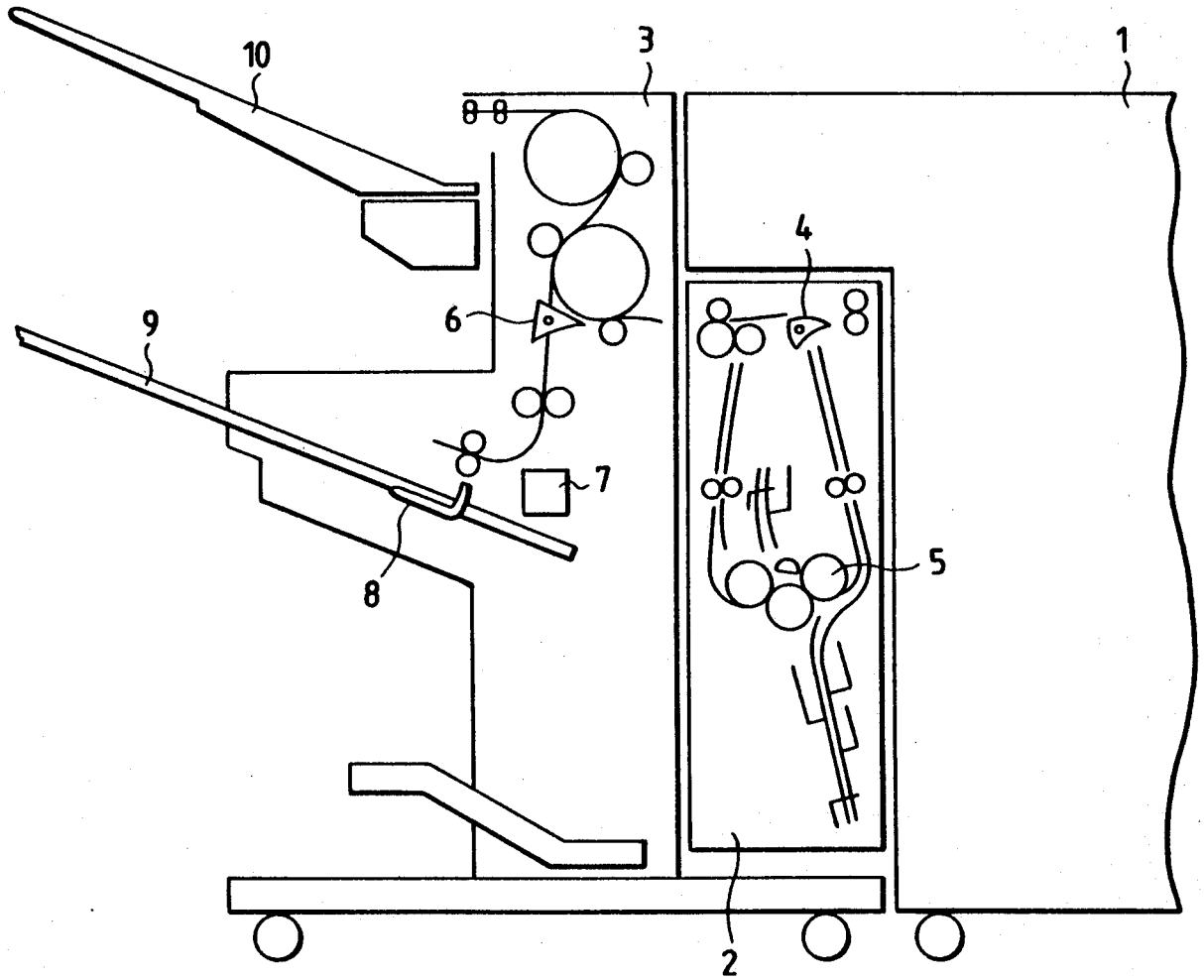
FIG. 2 is a sectional view schematically showing the construction of a paper fold unit and a staple unit.

FIG. 2 is a sectional view schematically showing the construction of a paper folding unit 2 and a stapling unit 3 mounted on a copying machine body 1 that is an embodiment of the present invention.

The paper folding unit 2 is a unit capable of folding a sheet of copied paper in two or in a Z form and has a mechanism including a fold/nonfold request switching lever 4 and a fold roller 5.

The stapling unit 3 is a unit for performing the binding function and is capable of binding the copied sheets using a staple.

The stapling unit 3 is provided with a staple/stack switching lever 6 for selecting a mode from the possible modes of binding a discharged copied sheet or just discharging it. The stapling unit 3 also has a staple containing mechanism 7, a staple dropping lever 8, a staple tray 9, a stacker tray 10, and the like.

Figure 3:
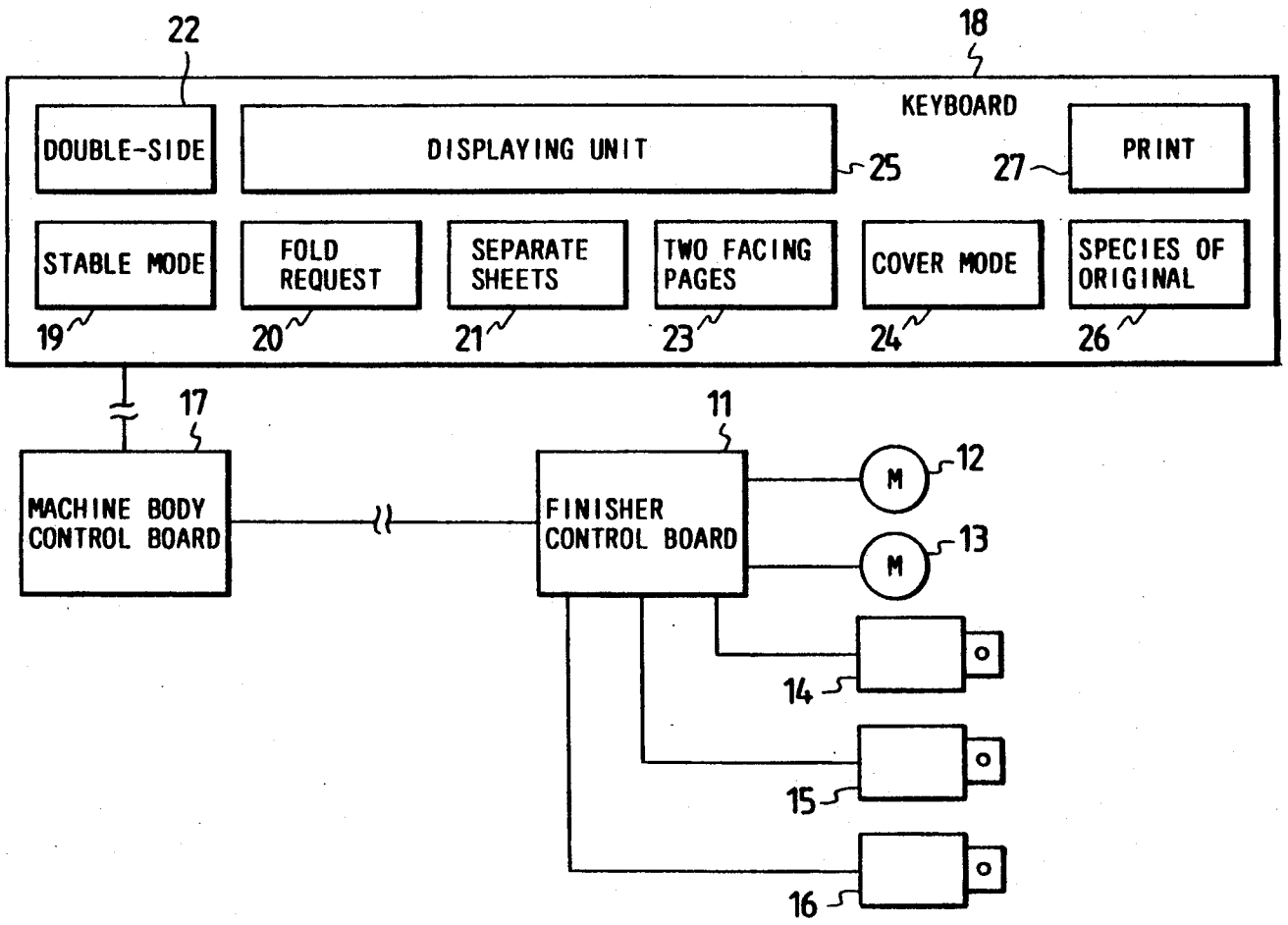
FIG. 3 is a block diagram showing the construction of a control mechanism in the embodiment of the present invention.

FIG. 3 is a block diagram showing the construction of an electric control unit that is an embodiment of the present invention.

The control section includes a finisher control board 11 for driving the paper folding unit 2 and the stapling unit 3. The finisher control board 11 controls a finisher motor 12, a stapling motor 13, a staple dropping lever solenoid 14, a staple/stack switching lever solenoid 15, a fold/unfold request switching lever solenoid 16, and the like.

The finisher motor 12 serves to drive various rollers included in the paper folding unit 2 and the stapling unit 3. The stapling motor 13 operates the staple containing mechanism 7. The staple dropping lever solenoid 14 operates the staple dropping lever 8 in binding the copied sheets. The staple/stack switching lever solenoid 15 serves to switch the staple/stack switching lever 6. The fold/unfold request switching lever solenoid 16 serves to switch the fold/unfold request switching lever 4.

The finisher control board 11 is connected to a machine body control board 17 arranged on the copying machine body 1, and a keyboard 18 that is arranged on the copying machine body 1 is connected to the machine body control board 17.

The keyboard 18 includes a staple mode selection button 19 for automatically binding the copied sheets by the stapling unit 3; a fold request mode selection button 20 for commanding automatically folding the copied sheets by the paper folding unit 2; a separate copying mode selection button 21 for copying both the front and rear sides of a double-sided original on two separate sheets; a double-sided copying mode selection button 22 for copying both sides of a sheet; a successive page copying mode selection button 23 for copying two facing pages of a book original on two separate sheets; a cover mode selection button 24 for inserting a front cover sheet, a back cover sheet, a partitioning sheet, and the like into the discharged copied sheets; an original type input button 26 for specifying that the original to be copied is either a double-sided original or a continuous page original; a print button 27 for instructing the copy start; and the like.

The keyboard 18 is also provided with a maximum bindable sheet count displaying unit 25 for displaying the maximum number of copied sheets that is bindable with staples, which is a feature of this embodiment. The maximum bindable sheet count displaying unit 25 may be constructed by a dedicated display unit as in this embodiment, or may be shared with a copied sheet count displaying unit. For such a shared display, it may be desirable that the maximum bindable sheet count be blinked, etc. so as to be distinguished from the copied sheet count display.

Figure 1:
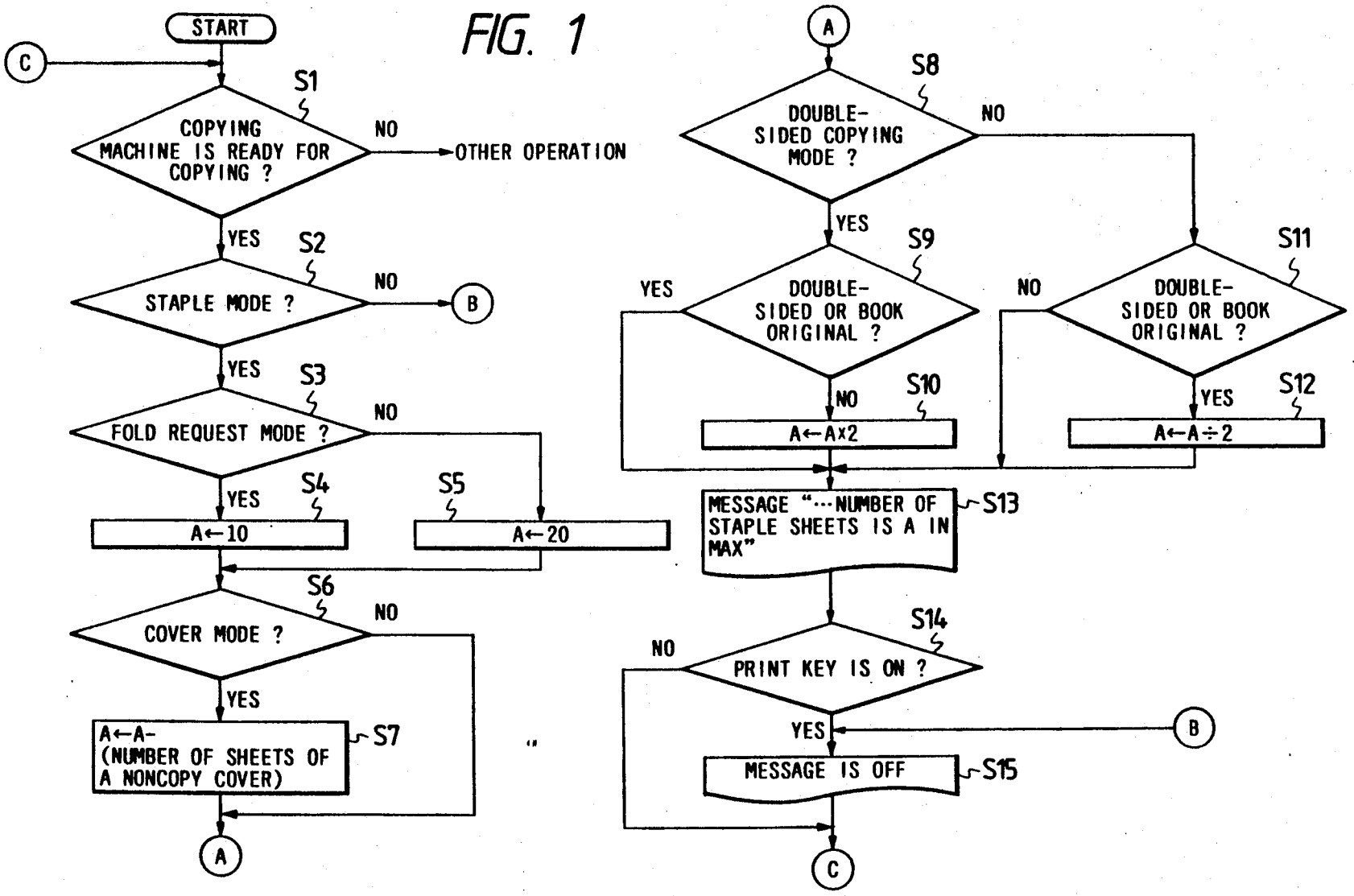
FIG. 1 is a flow chart showing the control operation of an embodiment of the present invention.

FIG. 1 is a flow chart showing the contents of a maximum bindable sheet count display control to be performed by the machine body control board 17.

A control operation, which is a feature of the present invention, will be described following the flow shown in FIG. 1 with reference to FIGS. 2 and 3 where necessary.

The machine body control board 17 judges whether or not the copying machine is ready to copy (Step S1), and executes other processing if the copying machine is not ready to copy. When the copying machine is ready to copy, the machine body control board 17 judges whether or not the staple mode is selected (Step S2). Upon pressing the staple mode selection button 19 of the keyboard 18, a staple mode selection signal is applied to the machine body control board 17, which then judges that the staple mode has been selected.

When the staple mode has been determined, the machine body control board 17 further judges whether or not the fold request mode (Step S3) has been selected. If the fold request mode selection button 20 has been pressed and the fold request mode has been selected, the machine body control board 17 sets "10" to a register A that is built therein (Step S4); if the unfold request mode has been selected, it sets "20" in the register A (Step S5).

The register A serves to set a maximum bindable sheet count, i.e., the largest number of copied sheets which can be bound with staples.

In this embodiment, a maximum of 20 copied sheets can be bound with staples. Generally, the number of sheets to be set for the original is equal to that of bindable copied sheets.

On the other hand, if the fold request mode has been selected, each of the copied sheets is folded in half, and thus the number of sheets to be bound is doubled. As a result, the number of sheets to be set to the register A must be half that to be set in the unfold request mode.

Then, the machine body control board 17 judges whether or not the cover mode has been selected (Step S6). If a signal from the cover mode selection button 24 has been applied, the machine body control board 17 judges that the cover mode has been selected and subtracts the number of sheets of a noncopy cover to be inserted into the copied sheets from the value set in the register A (Step S7).

Further, the machine body control board 17 judges whether or not the double-sided copying mode has been selected (Step S8), and also judges whether the type of original to be copied is a double-sided original or a continuous page original (book original) in both cases where the double-sided copying mode has been selected and the double-sided copying mode has not been selected (Steps S9, S11).

In the case where a single-sided ordinary original other than a double-sided original or a continuous page original is to be copied in the double-sided copying mode, the number of sheets set in the register A is doubled (Step S10) because the number of copied sheets becomes half that of the original.

In the case where a double-sided original or a continuous page original is to be copied in the double-sided copying mode, the contents of the register A is maintained unchanged. If a double-sided original or a continuous page original is to be copied in a mode other than the double-sided copying mode, the number of sheets set in the register A will be halved (Step S12) because the number of copied sheets becomes double that of the original.

In the case where an ordinary single-sided original other than a double-sided original or a continuous page original is to be copied in a mode other than the double-sided copying mode, the contents of the register A is maintained unchanged.

After the contents of the register A has been changed according to the copying conditions as described above, a message such as "Maximum bindable sheet count is 'A'" is displayed on the display unit 25 (Step S13).

This message informs the user of the upper limit of the number of sheets of an original which can be bound by staples, so that he or she can most efficiently use the staple binding technique.

Then, as the print key has been turned on (Step S14), the machine body control board 17 turns the message off (Step S15).

Although the contents of the register A is changed on the basis of the judgment on the type of original in Steps S9 and S11 in this embodiment, it may be possible to have such two types of message displayed as "Maximum bindable sheet count 'A, '" e.g., if the original is a double-sided original or a continuous page original, and "Maximum bindable sheet count '2A,'" otherwise, dispensing with the "type of original" judgment.

Also, it is desirable that the present invention should be used in combination with the sorting function thereby to contribute to reducing manpower and copying work.

Furthermore, in the case where the sorting function is conjointly employed, it is preferable to display the maximum sortable sheet count in a manner similar to the above control.

With the above described construction of this invention, the user can be informed of the maximum bindable sheet count before copying, so that he or she can make a copy utilizing the binding function effectively.

Therefore, a copying machine with an improved operability can be provided.

Although only a few embodiments have been described in detail above, those having ordinary skill in the art will certainly understand that many modifications are possible in the preferred embodiment without departing from the teachings thereof.

All such modifications are intended to be encompassed within the following claims.

I claim:

1. A copying machine having a binding function capable of automatically binding discharged copied sheets using a predetermined holding member for binding the copies sheets, comprising:

means for selecting a whether a binding function will be used;

means for setting a copying mode; and means for displaying, prior to copying, a maximum bindable number of sheets of an original based on an output of said selecting means and an output of said setting means.

2. A copying machine as in claim 1 wherein one of said modes of said setting means is whether sheets to be bound will be folded or not.

3. A copying machine as in claim 1 wherein one of said modes of said setting means is whether or not said sheets to be bound will be copies two-sided.

4. A copying machine having a binding function capable of automatically binding discharged copied sheets using a predetermined holding member for binding the copied sheets, comprising:

means for selecting a whether a binding function will be used;

means for displaying, prior to copying, a maximum bindable number sheets of an original based on an output of said selecting means; and means for determining said bindable number of sheets.

5. A copying machine as in claim 4, wherein said determining means includes means for determining if sheets to be bound will be folded and determining a number of bindable sheets to be a certain number if not, and another number less than said certain number if so.

6. A copying machine as in claim 4, wherein said determining means includes means for determining if sheets to be bound will be copied two sided, and determining said number of bindable sheets based thereon.

7. A copying machine as in claim 5, where said another number is half of said certain number.

8. A copying machine, comprising:

means for selecting a whether a binding function will be used to bind sheets which have been copied;

means for determining a number of sheets which can be bound based on copying options of the copying machine;

means for automatically binding discharged copied sheets using a predetermined holding member; and means for displaying, prior to copying, a maximum bindable number of sheets of an original based on an output of said selecting means and said determining means.

9. A method of operating a copying machine, comprising the steps of:

selecting a whether a binding function will be used to bind sheets which have been copied;

determining a number of sheets which can be bound based on copying options of the copying machine;

automatically binding discharged copied sheets using a predetermined holding member; and displaying, prior to copying, a maximum bindable number of sheets of an original based on an output of said selecting means and said determining means.

* * * * *